US010332477B2

(12) United States Patent
Chung et al.

(10) Patent No.: US 10,332,477 B2
(45) Date of Patent: Jun. 25, 2019

(54) DISPLAY DEVICE AND DRIVING METHOD THEREOF

(71) Applicant: AU OPTRONICS CORPORATION, Hsin-chu (TW)

(72) Inventors: Yueh-Hung Chung, Hsin-chu (TW); Ya-Ling Hsu, Hsin-chu (TW); Han-Ming Chen, Hsin-chu (TW); Chen-Hsien Liao, Hsin-chu (TW); Gang-Yi Lin, Hsin-chu (TW); Wen-Chen Lo, Hsin-chu (TW); Ming-Chang Shih, Hsin-chu (TW); Hsueh-Ying Huang, Hsin-chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 15/393,802

(22) Filed: Dec. 29, 2016

(65) Prior Publication Data

US 2017/0229091 A1 Aug. 10, 2017

(30) Foreign Application Priority Data

Feb. 4, 2016 (TW) ..... 105103811 A

(51) Int. Cl.
*G09G 3/36* (2006.01)
*G09G 5/00* (2006.01)

(52) U.S. Cl.
CPC ..... *G09G 5/003* (2013.01); *G09G 3/3614* (2013.01); *G09G 3/3648* (2013.01);
(Continued)

(58) Field of Classification Search
CPC ..... G09G 3/3614; G09G 3/3648; G09G 2310/0248; G09G 2310/0267;
(Continued)

(56) References Cited

U.S. PATENT DOCUMENTS 6,456,268 B1 * 9/2002 Takeda ..... G09G 3/3648 345/100
7,015,903 B2 * 3/2006 Lee ..... G09G 3/3648 345/212

(Continued)

FOREIGN PATENT DOCUMENTS

CN 104538003 A 4/2015

OTHER PUBLICATIONS

Office Action issued by the State Intellectual Property Office of the Peoples Republic of China (SIPO) dated Feb. 1, 2018 for Chinese Application No. 201610159822.3.

*Primary Examiner* — Michael J Eurice
(74) *Attorney, Agent, or Firm* — Tim Tingkang Xia, Esq.; Locke Lord LLP

(57) ABSTRACT

A display device includes a display array and a driving circuit. The display array includes at least one scan line. The driving circuit drives the display array and includes a timing controller and a gate driver. The timing controller controls a refresh rate of the display array at a first frequency or a second frequency, where the first frequency is higher substantially than the second frequency. The gate driver switches between supplying an enable voltage signal and a disable voltage signal to the scan line. Under the first or frequency, a corresponding first or second voltage difference exists between the enable voltage signal and the disable voltage signal. The first voltage difference is substantially greater than the second voltage difference, and the enable voltage signal has a same enable period.

8 Claims, 6 Drawing Sheets

(52) U.S. Cl.
CPC ..... *G09G 2310/0248* (2013.01); *G09G 2310/0267* (2013.01); *G09G 2310/0289* (2013.01); *G09G 2310/08* (2013.01); *G09G 2320/0233* (2013.01); *G09G 2320/0247* (2013.01); *G09G 2320/0252* (2013.01); *G09G 2330/02* (2013.01); *G09G 2340/0435* (2013.01)

(58) Field of Classification Search
CPC ..... G09G 2310/0289; G09G 2310/08; G09G 2320/0233; G09G 2320/0247; G09G 2320/0252; G09G 2340/0435
See application file for complete search history.

(56) References Cited

U.S. PATENT DOCUMENTS

2002/0027540 A1* 3/2002 Lee ..... G09G 3/3648 345/87
2003/0169247 A1* 9/2003 Kawabe ..... G09G 3/342 345/204
2006/0007084 A1* 1/2006 Takeoka ..... G09G 3/3648 345/87
2006/0125740 A1* 6/2006 Shirasaki ..... G09G 3/325 345/77
2006/0244710 A1* 11/2006 Iriguchi ..... G09G 3/3266 345/100
2006/0284811 A1* 12/2006 Huang ..... G02F 1/136213 345/92
2007/0132674 A1* 6/2007 Tsuge ..... G09G 3/2014 345/77
2008/0111773 A1* 5/2008 Tsuge ..... G09G 3/3241 345/76
2008/0218452 A1* 9/2008 Kohno ..... G09G 3/3233 345/76
2008/0309601 A1* 12/2008 Furukoshi ..... G09G 3/3648 345/89
2009/0115772 A1* 5/2009 Shiomi ..... G09G 3/342 345/214
2010/0231617 A1* 9/2010 Ueda ..... G09G 3/3648 345/690
2011/0122119 A1* 5/2011 Bae ..... G09G 3/3233 345/211
2011/0242140 A1* 10/2011 Lee ..... G09G 3/3648 345/690
2012/0146980 A1* 6/2012 Lee ..... G09G 3/2096 345/211
2012/0299970 A1* 11/2012 Bae ..... G09G 3/3648 345/690
2013/0002641 A1* 1/2013 Kim ..... G09G 3/3685 345/212
2013/0038621 A1* 2/2013 Choi ..... G09G 3/2092 345/589
2013/0314361 A1* 11/2013 Saitoh ..... G06F 3/0412 345/173
2014/0333604 A1* 11/2014 Omoto ..... G09G 3/3233 345/212
2015/0243212 A1* 8/2015 Lee ..... G09G 3/3216 345/212
2016/0111051 A1* 4/2016 Jeon ..... G09G 3/3674 345/204
2017/0103708 A1* 4/2017 Kim ..... G09G 3/3233
2017/0124934 A1* 5/2017 Verbeure ..... G09G 3/3611

* cited by examiner

DISPLAY DEVICE AND DRIVING METHOD THEREOF

CROSS-REFERENCE TO RELATED PATENT APPLICATION

This application claims the benefit of priority to Taiwan Patent Application No. 105103811, filed Feb. 4, 2016. The entire content of the above identified application is incorporated herein by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD

The present disclosure relates to a display device. Specifically, the present disclosure relates to a display device in which a refresh rate can be switched.

BACKGROUND

In recent years, as picture quality and resolutions of screens improve, complexity of animations and images processed by a display card also increases. However, during processing of complex animations or images, a display card needs a relatively long time to perform computation, and when a computation time cannot match a refresh rate of a display, a phenomenon of discontinuous frames occurs. To resolve this problem, some display devices can dynamically adjust a refresh rate, so as to reduce the refresh rate when a display card performs complex computation, thereby maintaining smooth frame output.

However, under the limit of material characteristics, when a refresh rate is reduced, brightness of a screen is reduced accordingly, causing problems that frames of a display device have uneven brightness and flicker when the refresh rate changes. Therefore, how to maintain stable brightness of a screen during dynamic adjustment of a refresh rate is an research subject in the field.

SUMMARY

An aspect of the present disclosure is a display device. The display device includes: a display array, including at least one scan line; and a driving circuit, configured to drive the display array. The driving circuit includes: a timing controller, configured to control a refresh rate of the display array at a first frequency or a second frequency, where the first frequency is substantially higher than the second frequency; and a gate driver, configured to switch between supplying an enable voltage signal and supplying a disable voltage signal to the scan line of the display array. When the refresh rate is at the first frequency, there is a first voltage difference between the enable voltage signal and the disable voltage signal, and when the refresh rate is at the second frequency, there is a second voltage difference between the enable voltage signal and the disable voltage signal. The first voltage difference is greater substantially than the second voltage difference.

Another aspect of the present disclosure is a driving method of a display device. The display device includes a display array and a driving circuit configured to drive the display array. The driving method includes: detecting a refresh rate of the display array; when the refresh rate of the display array is at a first frequency, switching between supplying an enable voltage signal and supplying a disable voltage signal to the display array, where there is a first voltage difference between the enable voltage signal and the disable voltage signal; and when the refresh rate of the display array is at a second frequency, switching between supplying the enable voltage signal and supplying the disable voltage signal to the display array, where there is a second voltage difference between the enable voltage signal and the disable voltage signal. The first frequency is substantially higher than the second frequency, and the first voltage difference is substantially greater than the second voltage difference.

DETAILED DESCRIPTION

Detailed description is provided below with reference to the embodiments and the companying drawings to further understand the aspects of the present disclosure. However, the provided embodiments are not used to limit the scope of the present disclosure. The description of structures and operations are not used to limit an execution sequence of the operations. Any apparatus having equivalent efficacy produced by using a structure of recombined elements falls within the scope of the present disclosure. In addition, according to standard and common measures in the industry, the drawings are only used for the purpose of assisting description and are not drawn by original sizes, and in fact, sizes of various features can be randomly increased or reduced for ease of description. The same elements are described by using the same symbols in the following description for ease of understanding.

The terms used in the entire specification and the claims, unless specifically indicated, usually have common meanings of the terms used in the art and in the disclosed content and special content. Some terms used to describe the present disclosure are discussed below or somewhere else in this specification, so as to provide additional guidance in the description of the present disclosure to a person skilled in the art.

In addition, the terms "comprise", "include", "have", "contain" and the like used herein are all non-exclusive words, that is, refer to "include, but is not limited thereto".

Moreover, "and/or" used herein includes any one or any combination of one or more items of related listed items.

When elements are "connected" or "coupled" herein, the elements may be "electrically connected" or "electrically coupled". "Connecting" and "coupling" may both refer to that two or more elements are interoperable or interacting. In addition, although the words "first", "second", . . . , are used herein to describe different elements, the words are only used to distinguish elements or operations that are described by using the same technical words. Unless specifically indicated in the context, the words do not specifically specify or imply an order or a sequence, and are not used to limit the present invention.

Figure 1:
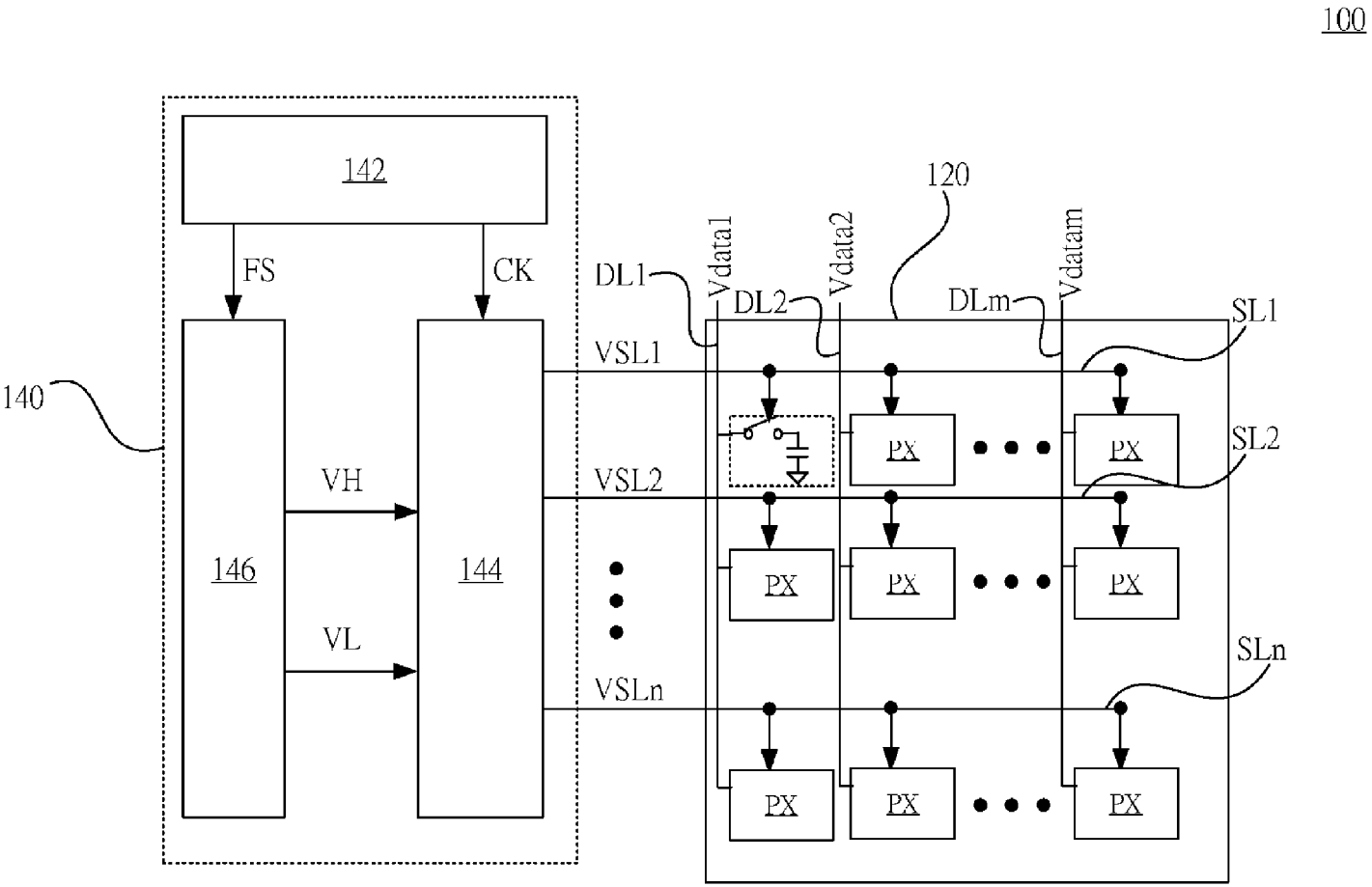
FIG. 1 is a schematic diagram of a display device according to some embodiments of the present disclosure.

Referring to FIG. 1, FIG. 1 is a schematic diagram of a display device 100 according to some embodiments of the present disclosure. As shown in FIG. 1, the display device 100 includes a display array 120 and a driving circuit 140. In some embodiments, the display array 120 includes a plurality of data lines DL1 to DLm, a plurality of scan lines SL1 to SLn, and multiple pixel units PX that are arranged into an array between the data lines DL1 to DLm and the scan lines SL1 to SLn. Each pixel unit PX is respectively electrically connected to the corresponding data lines DL1 to DLm and the corresponding scan lines SL1 to SLn.

Figure 2:
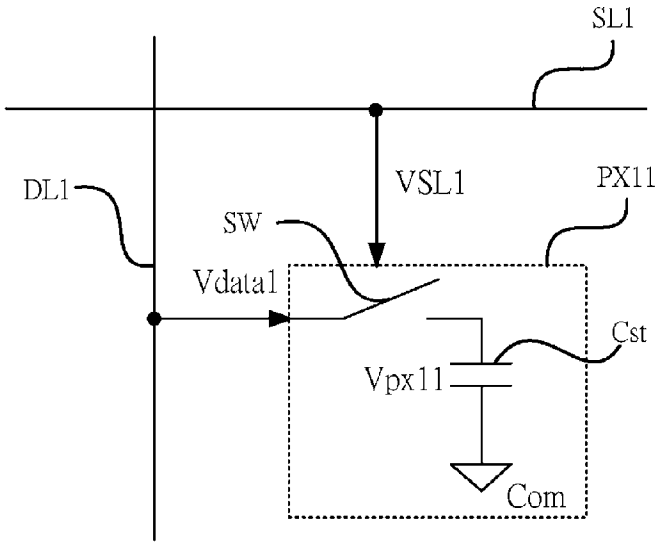
FIG. 2 is a schematic diagram of a pixel unit according to some embodiments of the present disclosure.

Referring FIG. 2 in combination, FIG. 2 is a schematic diagram of the pixel unit PX according to some embodiments of the present disclosure. As shown in FIG. 2, the pixel unit PX11 is electrically connected to the corresponding data line DL1 and the corresponding scan line SL1. Specifically, the pixel unit PX includes a switch SW and a storage capacitor Cst. A first end of the switch SW is electrically connected to the data line DL1, and is configured to receive a data voltage Vdata1. A second end of the switch SW is electrically connected to a first end of the storage capacitor Cst. A control end of the switch SW is electrically connected to the scan line SL1, and is configured to receive a scan voltage signal VSL1, so that the switch SW is selectively turned on according to the scan voltage signal VSL1. A second end of the storage capacitor Cst is electrically connected to a reference voltage Com. In this way, when the scan voltage signal VSL1 turns on the switch SW, the data voltage Vdata1 on the data line DL1 can charge the storage capacitor Cst.

Referring to FIG. 1 again, as shown in the figure, in some embodiments, the driving circuit 140 is electrically connected to the display array 120, and is configured to drive the display array 120. As shown in FIG. 1, the driving circuit 140 includes a timing controller 142, a gate driver 144, and a control unit 146. Specifically, the timing controller 142 may dynamically control a refresh rate of the display array 120 by outputting a clock signal CK. For example, the timing controller 142 may control the refresh rate of the display array 120 at 144 hertz (Hz), 60 hertz (Hz), 30 hertz (Hz), and the like. When an image processed by a display card is excessively complex and a relatively long time is needed to perform data computation, the timing controller 142 may control the display array 120 at a relatively low refresh rate (for example, 30 hertz), so as to prevent a phenomenon of delayed or discontinuous frames from occurring.

The gate driver 144 is electrically connected to the timing controller 142 and the scan lines SL1 to SLn. The gate driver 144 receives the clock signal CK from the timing controller 142, and switches between supplying an enable voltage signal (for example, a high level) and supplying a disable voltage signal (for example, a low level) to the scan lines SL1 to SLn of the display array 120. As shown in FIG. 1, in some embodiments, the gate driver 144 respectively outputs scan voltage signals VSL1 to VSLn to the corresponding scan lines SL1 to SLn. When the scan voltage signal VSL1 is at a high level and the scan voltage signals VSL2 to VSLn are at a low level, the gate driver 144 enables the scan line SL1. When the scan voltage signal VSL2 is at a high level and the scan voltage signals VSL1 and VSL3 to VSLn are at a low level, the gate driver 144 enables the scan line SL2, and the like. In this way, by enabling the scan lines SL1 to SLn in turn, the gate driver 144 may drive the pixel unit PX in the display array 120 corresponding to the refresh rate of the display array 120.

The control unit 146 is electrically connected to the timing controller 142 and the gate driver 144. In some embodiments, the timing controller 142 outputs a corresponding frequency detection signal FS to the control unit 146 according to the refresh rate of the display array 120. In some embodiments, the timing controller 142 may determine the current refresh rate of the display array 120 according to a period of a frame on the display array 120, to output the frequency detection signal FS. In this way, the control unit 146 may adjust a voltage level of an enable reference voltage VH according to the frequency detection signal FS received from the timing controller 142.

In some embodiments, the control unit 146 may also choose to adjust a voltage level of the enable reference voltage VH or a disable reference voltage VL according to the frequency detection signal FS, or simultaneously adjust the voltage levels of the enable reference voltage VH and the disable reference voltage VL. In this way, the control unit 146 may determine the refresh rate of the display array 120 according to a different frequency detection signal FS, and output the corresponding enable reference voltage VH and the disable reference voltage VL to the gate driver 144. Accordingly, the gate driver 144 may respectively supply the enable voltage signal and the disable voltage signal to the scan lines SL1 to SLn of the display array 120 according to the enable reference voltage VH and the disable reference voltage VL.

Specifically, in some embodiments, when the refresh rate is relatively high, a voltage difference between the enable voltage signal and the disable voltage signal (that is, a voltage difference between the enable reference voltage VH and the disable reference voltage VL) is relatively large. When the refresh rate is relatively low, the voltage difference between the enable voltage signal and the disable voltage signal (that is, the voltage difference between the enable reference voltage VH and the disable reference voltage VL) is relatively small. For ease of description, in the following paragraphs, a relationship between the refresh rate of the display array 120 and the voltage difference between the enable voltage signal and the disable voltage signal is described in detail with reference to the embodiments and the accompanying drawings.

Figure 3:
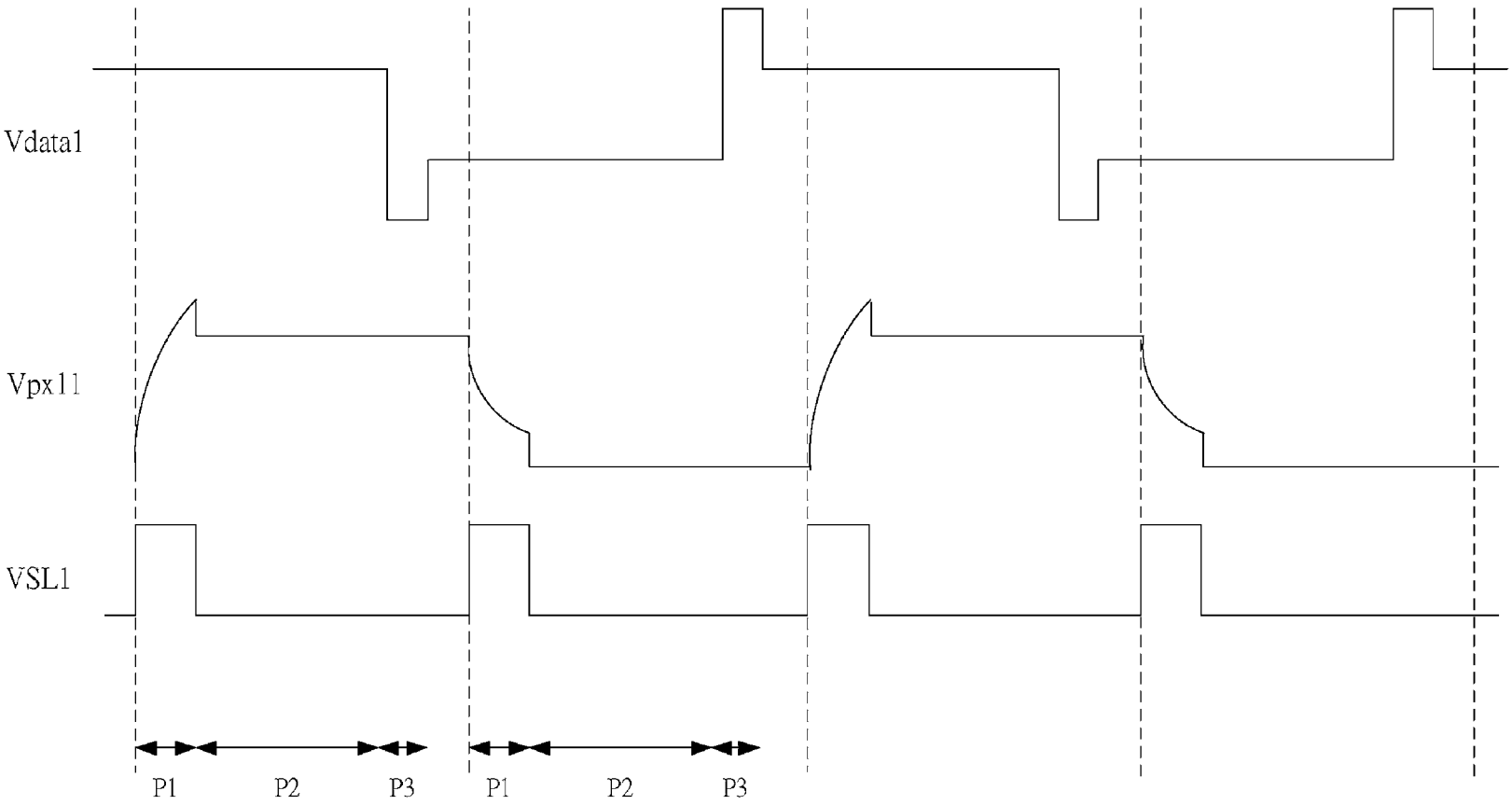
FIG. 3 and FIG. 4 are respectively schematic waveform diagrams of a data voltage signal, a pixel voltage, and a scan voltage signal when the display device is at different refresh rates according to some embodiments of the present disclosure.
Figure 4:
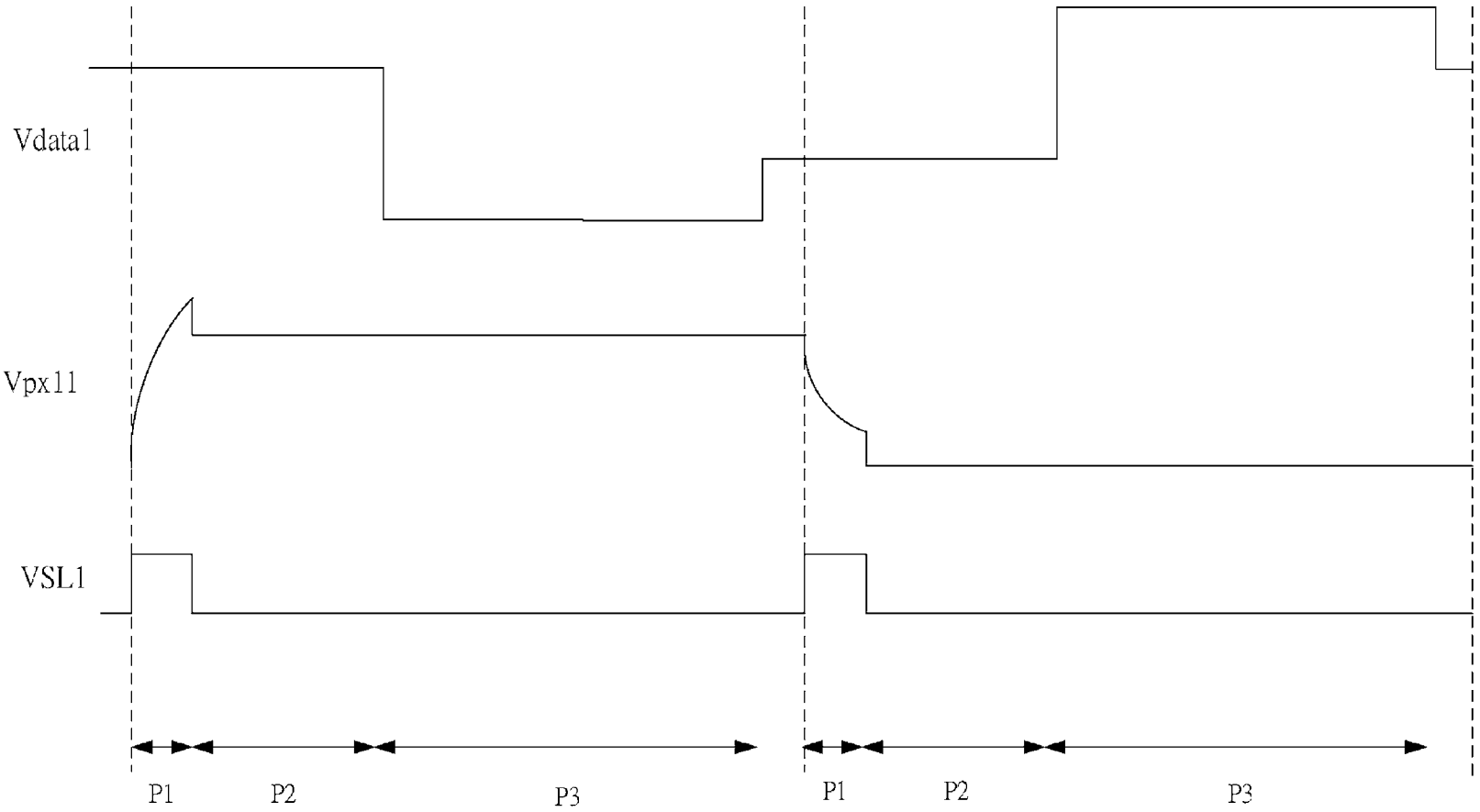

Referring to FIG. 3 and FIG. 4, FIG. 3 and FIG. 4 are respectively schematic waveform diagrams of a data voltage signal, a pixel voltage, and a scan voltage signal when the display device 100 is at different refresh rates according to some embodiments of the present disclosure. For ease of description, the voltage waveforms in FIG. 3 and FIG. 4 are described with reference to the display device 100 in the embodiment shown in FIG. 1 and FIG. 2. In some embodiments, FIG. 3 is a schematic waveform diagram of a data voltage signal, a pixel voltage, and a scan voltage signal when the display device 100 is at a refresh rate of 144 hertz, where 144 frames are included per second. FIG. 4 is a schematic waveform diagram of a data voltage signal, a pixel voltage, and a scan voltage signal when the display device 100 is at a refresh rate of 30 hertz, where 30 frames are included per second.

When the display device 100 is at a refresh rate of 144 hertz, as shown in FIG. 3, in each frame, within first timing P1, the scan voltage signal VSL1 is at a high level (that is, the voltage level of the enable reference voltage VH). In this case, the switch SW is turned on, and a data voltage signal Vdata1 charges a pixel voltage Vpx11 between two ends of the storage capacitor Cst. In second timing P2, the scan voltage signal VSL1 is switched from a high level (that is, the voltage level of the enable reference voltage VH) to a low level (that is, the voltage level of the disable reference voltage VL). In this case, because of the existence of parasitic capacitance, the pixel voltage Vpx11 is affected during timing switching to cause a voltage drop, and the part of the voltage drop of the pixel voltage Vpx11 is a feed through voltage.

Next, in third timing P3, the pixel unit is in a blanking stage. In this case, the data voltage signal Vdata1 is kept at a fixed level, so that charging and discharging of the parasitic capacitance are avoided, to reduce a leakage current on the data line DL1, thereby reducing power consumption of a panel. In this stage, output of the data voltage signal Vdata1 does not change a voltage level of the pixel voltage Vpx11. In some embodiments, a voltage level of the data voltage signal Vdata1 in the third timing P3 has reversed polarity. In some other embodiments, the voltage level of the data voltage signal Vdata1 in the third timing P3 may also have non-reversed polarity. Therefore, the embodiment shown in FIG. 3 is only one of the possible implementation manners of the present disclosure, and is not used to limit the present disclosure.

In some embodiments, when the display device 100 is at a refresh rate of 144 hertz, the enable voltage signal (that is, the scan voltage signal VSL1 at a high level) is approximately 30 volts (V). The disable voltage signal (that is, the scan voltage signal VSL1 at a low level) is approximately −6 volts (V).

When the display device 100 is switched to a refresh rate of 30 hertz, as shown in FIG. 4, each frame also includes the first timing P1, the second timing P2, and the third timing P3. As compared with that the display device 100 is at a refresh rate of 144 hertz, a period of the first timing P1 is the same. In other words, regardless of whether the refresh rate of the display array 120 is at 144 hertz or 30 hertz, an enable (charging) period in which the gate driver 144 supplies the enable voltage signal is the same. In contrast, when the refresh rate is at 30 hertz, a time of the third timing P3 is relatively long. When the refresh rate is at 144 hertz, the time of the third timing P3 is relatively short. In other words, the gate driver 144 may adjust a time length during which the data voltage signal Vdata1 is kept at a fixed level to make the pixel unit PX in a blanking stage. In this way, even if an enable period during which the gate driver 144 supplies the enable voltage signal is the same, the gate driver 144 may still adjust a time period of each frame, thereby implementing that the display array 120 is at different refresh rates.

In some embodiments, when the display device 100 is at a refresh rate of 30 hertz, the enable voltage signal (that is, the scan voltage signal VSL1 at a high level) is approximately 22 volts (V). The disable voltage signal (that is, the scan voltage signal VSL1 at a low level) is approximately −6 volts (V).

In other words, when the refresh rate is relatively high (for example, 144 Hz), the voltage difference between the enable voltage signal and the disable voltage signal is relatively large (for example, 36 V). When the refresh rate is relatively low (for example, 30 Hz), the voltage difference between the enable voltage signal and the disable voltage signal is relatively small (for example, 28 V). Specifically, the driving circuit 140 may output, corresponding to the refresh rate by using the control unit 146, the enable reference voltage VH having a different voltage level to implement the foregoing operation.

Figure 5A:
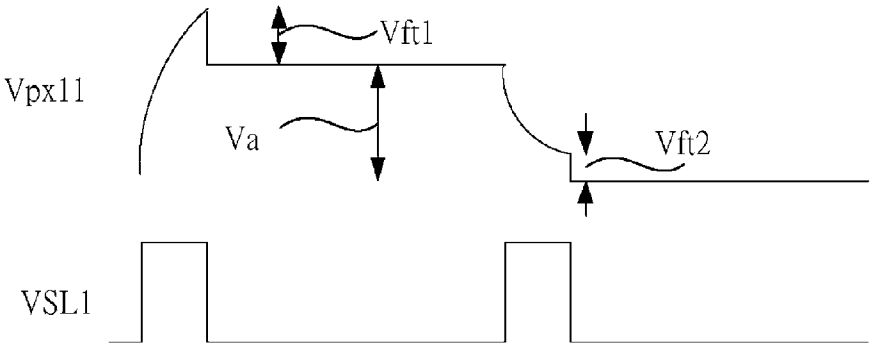
FIG. 5A and FIG. 5B are schematic waveform diagrams of the scan voltage signal and the pixel voltage according to some embodiments of the present disclosure.
Figure 5B:
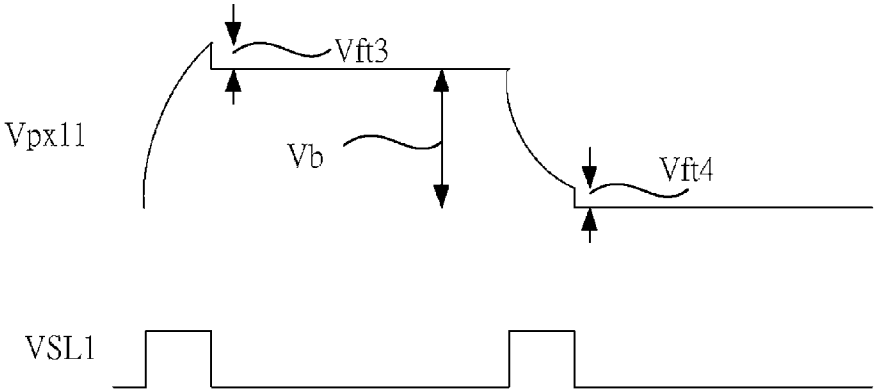

Referring to FIG. 5A and FIG. 5B, FIG. 5A and FIG. 5B are schematic waveform diagrams of the scan voltage signal VSL1 and the pixel voltage Vpx11 according to some embodiments of the present disclosure. As shown in FIG. 5A, when the scan voltage signal VSL1 is turned off, regardless of whether the pixel voltage Vpx11 has a positive polarity or negative polarity, the feed through voltage respectively causes voltage drops Vft1 and Vft2. As shown in the figures, the induced voltage drop Vft1, when the pixel voltage Vpx11 has a positive polarity, is substantially greater than the induced voltage drop Vft2, when the pixel voltage Vpx11 has a negative polarity. Similarly, in FIG. 5B, the feed through voltage also respectively causes the voltage drops Vft3 and Vft4 in the pixel voltage Vpx11. As shown in the figures, the induced voltage drop Vft3, when the pixel voltage Vpx11 has a positive polarity, is substantially greater than the induced voltage drop Vft4, when the pixel voltage Vpx11 has a negative polarity.

Furthermore, the voltage drops Vft1 to Vft4 caused by the feed through voltage are directly proportional to a voltage difference between a high level and a low level of the scan voltage signal VSL1. Therefore, in a case in which the induced voltage drops Vft1 and Vft3, when the pixel voltage Vpx11 has a positive polarity, are respectively substantially greater than the induced voltage drops Vft2 and Vft4, when the pixel voltage Vpx11 has a negative polarity. When the voltage difference between the high level and the low level of the scan voltage signal VSL1 is larger, a cross voltage between positive polarity and negative polarity of the pixel voltage Vpx11 is smaller.

In other words, because an enable level of the scan voltage signal VSL1 in FIG. 5A is substantially greater than the enable level of the scan voltage signal VSL1 in FIG. 5B, a cross voltage Va between positive polarity and negative polarity of the pixel voltage Vpx11 in FIG. 5A is substantially less than a cross voltage Vb between positive polarity and negative polarity of the pixel voltage Vpx11 in FIG. 5B. In this way, the cross voltage between positive polarity and negative polarity of the pixel voltage Vpx11 may be increased by reducing the voltage difference between the high level and the low level of the scan voltage signal VSL1. When the cross voltage between positive polarity and negative polarity of the pixel voltage Vpx11 is increased, brightness of a pixel PX is increased accordingly.

Accordingly, compensation may be performed on brightness of the display array 120 by adjusting the enable level or a disable level of the scan voltage signal VSL1, so that brightness of the display array 120 stays consistent at different refresh rates, thereby preventing a case of flickering frames from occurring. Specifically, in some embodiments, when the refresh rate is reduced, brightness of the pixel PX is reduced due to material characteristics. Therefore, when reduction of the refresh rate of the display array 120 is detected, the control unit 146 may synchronously reduce the voltage difference between the high level and the low level of the scan voltage signal VSL1.

In some embodiments, the control unit 146 may adjust the voltage level of the enable reference voltage VH according to the refresh rate, and maintain the voltage level of the disable reference voltage VL unchanged, so that when the refresh rate is at a first frequency (for example, 144 Hz), the enable voltage signal has a first level (for example, 30 V), and when the refresh rate is at a second frequency, the enable voltage signal has a second level (for example, 25 V) substantially less than the first level. At different refresh rates, the disable voltage signal has a same voltage level (for example, −6 V), but the present disclosure is not limited thereto.

For example, in some other embodiments, the control unit 146 may also adjust the voltage level of the disable reference voltage VL according to the refresh rate, and maintain the voltage level of the enable reference voltage VH unchanged, so that when the refresh rate is at the first frequency (for example, 144 Hz), the disable voltage signal has a first level (for example, −6 V), and when the refresh rate is at the second frequency, the disable voltage signal has a second level (for example, −1 V) substantially higher than the first level. At different refresh rates, the enable voltage signal has a same voltage level (for example, 30 V). In other words, in a manner of adjusting one of the enable reference voltage VH and the disable reference voltage VL and maintaining the other unchanged, the control unit 146 may provide the scan voltage signal VSL1 with a relatively large voltage difference when the refresh rate is relatively high, and may provide the scan voltage signal VSL1 with a relatively small voltage difference when the refresh rate is relatively high, so as to perform compensation on the brightness of the display array 120.

For the voltage level and the refresh rate in the foregoing embodiments, quantities and values of the voltage level and the refresh rate are only exemplary, and are not used to limit the present disclosure. For example, in some embodiments, the display device 100 may be at three or more different refresh rates, and the timing controller 142 may output corresponding frequency detection signals FS according to different refresh rates, so that the control unit 146 adjusts the voltage levels of the enable reference voltage VH and the disable reference voltage VL respectively corresponding to the different refresh rates.

For example, in some embodiments, the timing controller 142 may control the refresh rate of the display array 120 at the first frequency (for example, 144 Hz), the second frequency (for example, 60 Hz) or a third frequency (for example, 30 Hz). When the refresh rate is at the first frequency, there is a first voltage difference between the enable voltage signal and the disable voltage signal, when the refresh rate is at the second frequency, there is a second voltage difference between the enable voltage signal and the disable voltage signal, and when the refresh rate is at the third frequency, there is a third voltage difference between the enable voltage signal and the disable voltage signal. The first voltage difference is substantially greater than the second voltage difference, and the second voltage difference is substantially greater than the third voltage difference. For example, the control unit 146 may maintain the voltage level of the disable reference voltage VL at −6 V, and adjust the voltage level of the enable reference voltage VH to 30 V at the first frequency (for example, 144 Hz), to 26 V at the second frequency (for example, 60 Hz), and to 22 V at the third frequency (for example, 30 Hz), so as to implement the foregoing operation.

Figure 6:
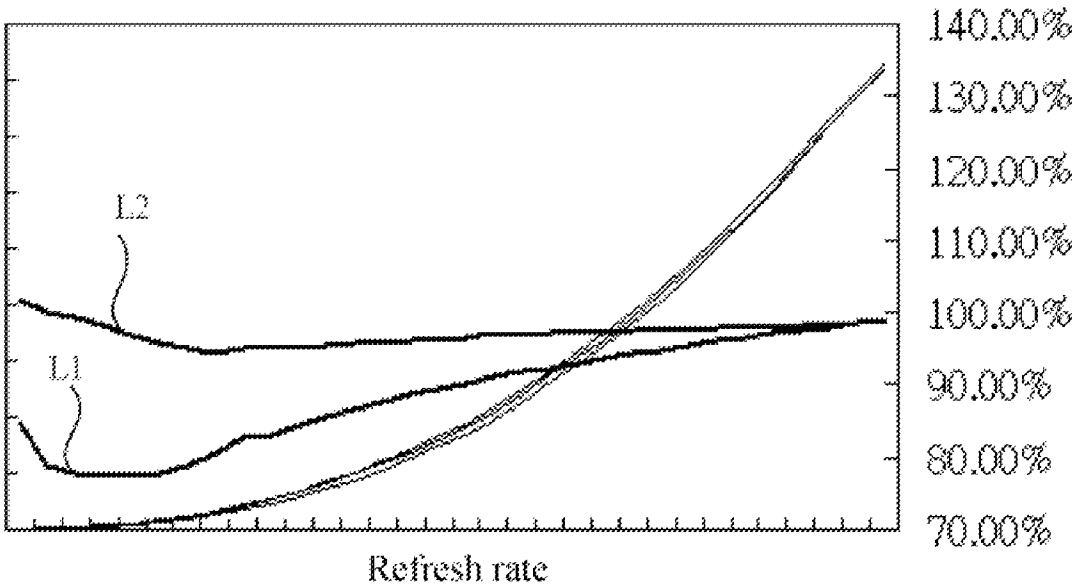
FIG. 6 is a characteristic curve diagram of a refresh rate to a brightness change according to some embodiments of the present disclosure.

Referring to FIG. 6, FIG. 6 is a characteristic curve diagram of a refresh rate to a brightness change according to some embodiments of the present disclosure, wherein a horizontal axis represents the refresh rate, and a vertical axis represents a proportion of the brightness change. In FIG. 6, a curve L1 represents a brightness change of the display array 120 when the enable reference voltage VH is not adjusted according to the refresh rate. A curve L2 represents the brightness change of the display array 120 when the enable reference voltage VH is correspondingly adjusted according to the refresh rate. As shown in FIG. 6, when the enable reference voltage VH is adjusted corresponding to the refresh rate, compensation of brightness from approximately 77% to approximately 95% may be performed. In this way, brightness of the display array 120 stays consistent at different refresh rates, thereby preventing a case of flickering frames from occurring.

In conclusion, in the present disclosure, by means of application of certain foregoing embodiments, a voltage difference between a high level and a low level of a scan voltage signal is adjusted corresponding to a refresh rate, so that brightness compensation can be performed on pixels in a display array, so as to improve output quality of display frames.

Although the present disclosure is disclosed as above by using the implementation manners, the implementation manners are not used to limit the present disclosure. Any person skilled in the art may make various variations and modifications without departing from the spirit and scope of the present disclosure, and therefore the protection scope of the present disclosure should be as defined by the appended claims.

What is claimed is:

1. A display device, comprising:

a display array, comprising at least one scan line; and a driving circuit, configured to drive the display array, the driving circuit comprising:

a timing controller, configured to control a refresh rate of the display array at a first frequency or a second frequency, wherein the first frequency is substantially higher than the second frequency; and a gate driver, configured to switch between supplying a first voltage signal for enabling and supplying a second voltage signal for disabling to the at least one of scan line of the display array, wherein when the refresh rate is at the first frequency, there is a first voltage difference between the first voltage signal and the second voltage signal, and when the refresh rate is at the second frequency, there is a second voltage difference between the first voltage signal and the second voltage signal, wherein the first voltage difference is substantially greater than the second voltage difference, and a first enable period of the first voltage signal when the refresh rate is at the first frequency is the same as a second enable period of the first voltage signal when the refresh rate is at the second frequency;

wherein when the refresh rate is at the first frequency, the first voltage signal has a first level, and when the refresh rate is at the second frequency, the first voltage signal has a second level, wherein the first level is substantially higher than the second level.

2. The display device according to claim 1, wherein the timing controller is further configured to control the refresh rate of the display array at the first frequency, the second frequency or a third frequency, wherein the second frequency is substantially higher than the third frequency, wherein when the refresh rate is at the third frequency, there is a third voltage difference between the first voltage signal and the second voltage signal, wherein the second voltage difference is substantially greater than the third voltage difference, and the second enable period of the first voltage signal when the refresh rate is at the second frequency is the same as a third enable period of the first voltage signal when the refresh rate is at the third frequency.

3. The display device according to claim 1, wherein when the refresh rate is at the first frequency, the second voltage signal has a first level, and when the refresh rate is at the second frequency, the second voltage signal has a second level, wherein the first level is substantially less than the second level.

4. The display device according to claim 3, wherein when the refresh rate of the display array is at the first frequency or the second frequency, the first voltage signal has a same voltage level.

5. The display device according to claim 1, wherein the driving circuit further comprises a control unit; and the timing controller is further configured to output a frequency detection signal according to the refresh rate of the display array, the control unit is configured to adjust a voltage level of an enable reference voltage according to the frequency detection signal, and the gate driver is further configured to supply the first voltage signal to the scan line of the display array according to the enable reference voltage.

6. The display device according to claim 5, wherein the timing controller is further configured to determine the refresh rate according to a period of a frame on the display array to output the frequency detection signal.

7. A driving method of a display device, wherein the display device comprises a display array and a driving circuit configured to drive the display array, the driving method comprising:

detecting a refresh rate of the display array;

when the refresh rate of the display array is at a first frequency, switching between supplying a-first voltage signal for enabling and supplying a second voltage signal for disabling to the display array, wherein there is a first voltage difference between the first voltage signal and the second voltage signal; and when the refresh rate of the display array is at a second frequency, switching between supplying the first voltage signal and supplying the second voltage signal to the display array, wherein there is a second voltage difference between the first voltage signal and the second voltage signal, wherein the first frequency is substantially higher than the second frequency, the first voltage difference is substantially greater than the second voltage difference, and a first enable period of the first voltage signal when the refresh rate is at the first frequency is the same as a second enable period of the first voltage signal when the refresh rate is at the second frequency, and wherein when the refresh rate is at the first frequency, the first voltage signal has a first level, and when the refresh rate is at the second frequency, the first voltage signal has a second level, wherein the first level is substantially higher than the second level.

8. The driving method according to claim 7, further comprising:

outputting a frequency detection signal according to the refresh rate;

adjusting a voltage level of an enable reference voltage or a disable reference voltage according to the frequency detection signal; and supplying the first voltage signal and the second voltage signal according to the enable reference voltage and the disable reference voltage respectively.

* * * * *